United States Patent [19]

Gillespie

[11] 4,268,930

[45] May 26, 1981

[54] INFLATABLE MINI BOAT

[75] Inventor: George P. Gillespie, Plumstead Township, Bucks County, Pa.

[73] Assignee: The United States of America as represented by the Secretary of the Navy, Washington, D.C.

[21] Appl. No.: 812,034

[22] Filed: Jul. 1, 1977

[51] Int. Cl.[3] ..... B63B 7/00

[52] U.S. Cl. ..... 9/2 A; 9/11 A

[58] Field of Search ..... 9/2 A, 11 A, 347, 348, 9/13; 297/DIG. 3

[56] References Cited

U.S. PATENT DOCUMENTS

| | | | |
|---|---|---|---|
| 1,372,528 | 3/1921 | Marcovsky | 9/2 A |
| 2,508,304 | 5/1950 | Sturtevant | 9/2 A |
| 2,962,732 | 12/1960 | März | 9/2 A |
| 2,987,114 | 6/1961 | Klepper | 9/11 A |
| 4,090,270 | 5/1978 | Horan | 9/2 A |

FOREIGN PATENT DOCUMENTS

| | | | |
|---|---|---|---|
| 326248 | 3/1935 | Italy | 9/2 A |

*Primary Examiner*—Sherman D. Basinger

*Attorney, Agent, or Firm*—R. S. Sciascia; Henry Hansen; Stanton D. Weinstein

[57] ABSTRACT

A mini boat having a first plurality of elongated gas inflatable cells stacked one upon the other and bonded into a single envelopmental unit which conforms closely to the human body for providing buoyancy thereof. The unit is formed to provide a center of mass below the center of buoyancy for increased boarding ease and stability. A supplementary orally inflatable chamber formed atop the first plurality of cells provides additional freeboard for the boat perimeter. One end of the boat is arcuately configured to permit the user to recline therein, thereby protecting him from the elements and lowering his center of gravity, by means of regularly spaced and separated and vertically aligned interconnections between the first plurality of cells which provide points of easy bending.

2 Claims, 4 Drawing Figures

INFLATABLE MINI BOAT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to buoyant water-borne vessels, and more particularly to small inflatable boats.

Those concerned with the development of sea rescue systems have long recognized the need for a life boat which is highly compact when stored, easily deployed, and adequate to support the user above the water when deployed. One such boat is disclosed in U.S. Pat. application Ser. No. 745,736 filed Nov. 29, 1976, by John J. Horan, now U.S. Pat. No. 4,090,270 issued May 23, 1978 for an inflatable mini-boat which is only partially inflated for boarding case along the upper sides by a supply of compressed carbon dioxide gas for boarding ease. After boarding, the lower sides may be orally inflated by the user. Freeboard can be increased by bailing but this may be difficult in rough seas or hazardous particularly in shark-infested waters wherein the splashing attracts the predator. In addition, such a boat tends to open upon inflation in a V-shape to accept the user. As a result, the lower portion of the sides compress the user while the upper portion fits loosely. The position of the user also becomes uncomfortable and reduces boat stability.

SUMMARY OF THE INVENTION

Accordingly, it is a general purpose of the present invention to provide a collapsible, inflatable mini boat having readily increased freeboard.

Other objects of the present invention are to provide a mini boat which snugly fits the user without discomfort, which with the user therein has a low center of gravity, which has good stern freeboard, and which has increased stability.

Further objects of the present invention are to provide a mini boat permitting good posture of the user, increasing the user's comfort, allowing full user chest expansion for oral inflation of the boat, positioning the user's body low in the boat, and being easily bailable.

Briefly, these and other objects of the invention are accomplished by an inflatable mini boat having respective portions inflated from a pressurized gas container and orally by the user, wherein a portion of the orally inflated section of the boat is disposed about the upper open rim of the boat so that freeboard can be readily increased after pressurized gas inflation and entry of the user has been accomplished. The pressurized gas inflated section of the boat comprises a plurality of longitudinally extending inflatable cells stacked one above the other and having a plurality of vertically aligned interconnections in one end (the stern) of the boat, causing the boat to bend at those interconnections so that that end of the boat is curved. As a result of this bending, the sides of the boat are held separated from each other, increasing the user's comfort, and the user can lean back in the curved end of the boat, thus lowering the combined center of gravity of the boat and user for increased stability. This initial shape is retained when the rest of the boat is orally inflated. The bottom contour of the boat allows the user to keep his "hip to foot" line relatively straight and gives a greater keel area for increased freeboard. The longitudinal cells of which the sides of the boat are comprised are straight and not curved or bent, resulting in straight sides for the boat. The straight sides and curved end of the boat result in a snug fitting boat which is more stable than a loose fitting boat. In addition, disposal of the lower orally inflated portion of the boat is balanced about the unit center of mass with respect to the load to be experienced by the boat, so that bow freeboard is reduced and stern freeboard correspondingly increased.

Other objects, advantages and novel features of the invention will become apparent from the following detailed description of the invention when considered in conjunction with the accompanying drawings wherein:

DESCRIPTION OF THE PREFERRED EMBODIMENT

Figure 2:
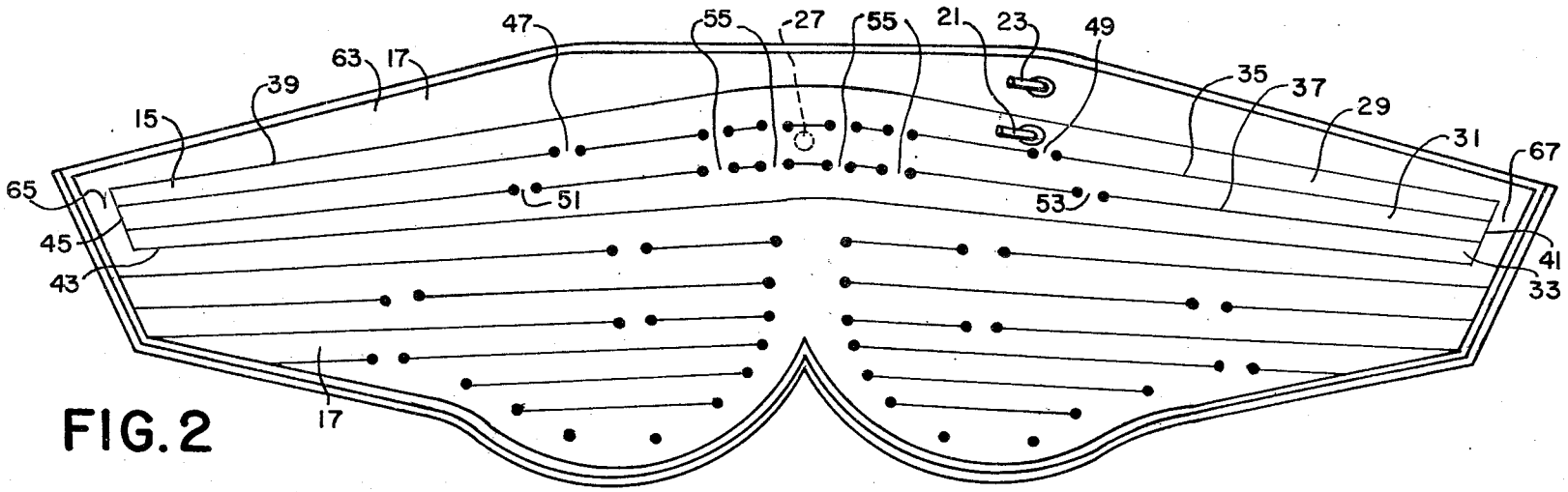
FIG. 2 shows the symmetrical pattern which is used to fabricate the inner and outer panels of the invention shown in FIG. 1, together with the location of seaming lines and inflation device entrances.
Figure 3:
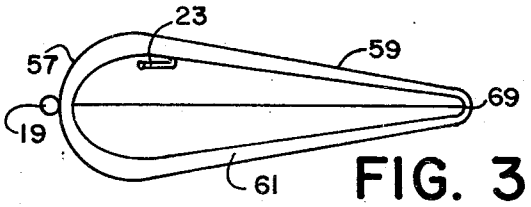
FIG. 3 shows a top view of the boat of FIG. 1.
Figure 4:
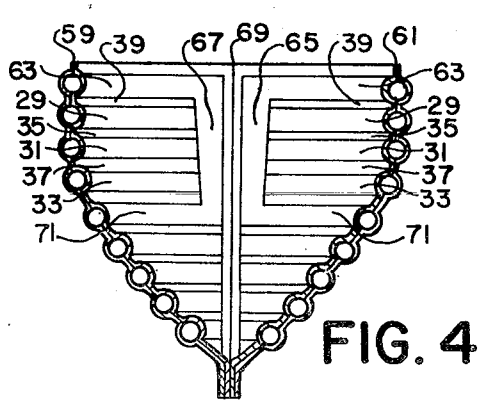
FIG. 4 illustrates a section of the boat or mini boat taken on the line 3—3 of FIG. 1.
Figure 1:
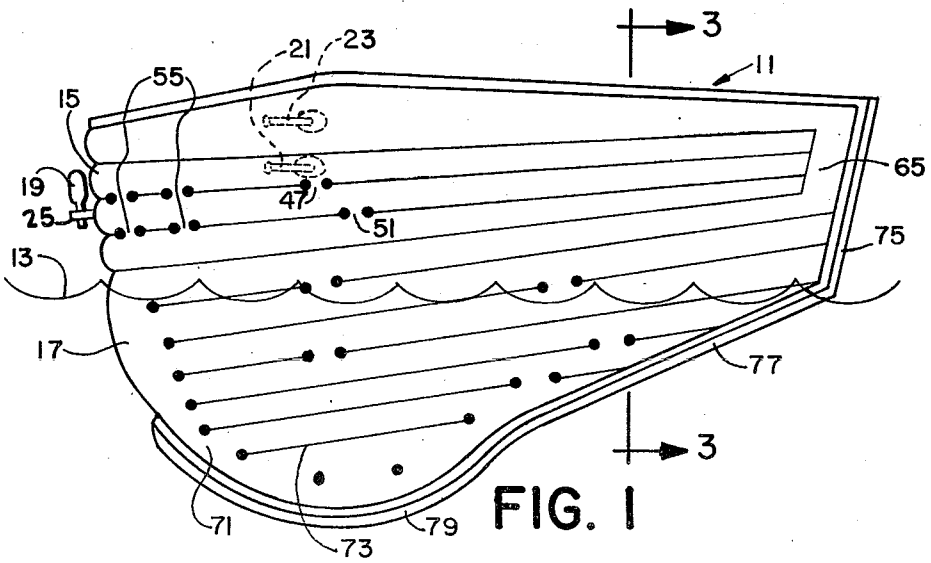
FIG. 1 shows a side elevation of a boat according to the present invention disposed on water.

Referring now to the drawings, wherein like reference characters designate like or corresponding parts throughout the several views, there is shown in FIG. 1 a mini boat 11 buoyantly disposed on water 13. The raft comprises two separately inflated cells 15 and 17. Inflatable cell 15 can be inflated by the pressurized gas supply 19 or by oral inflation tube 21 connected thereto. Inflatable cell 17 is orally inflatable via oral inflation tube 23 connected thereto. As can be seen in FIG. 2, pressurized gas supply 19, which can for example be a pressurized carbon dioxide gas cylinder or bottle, is connected to inflate cell 15 via valve 25 and opening 27. Oral inflation tubes 21 and 23 can each be a one-way inflation valve which will admit but not release exhausted air orally supplied by the user. Valve 25 connected between supply 19 and inflatable section 15 is a one-way check valve which will permit pressurized gas to flow from supply 19 into cell 15 but prevents flow from cell 15 to supply 19. Valve 25 prevents any flow therethrough until actuated by the user, for example via a pull chain attached thereto. Inflatable section 15 includes three tubular inflatable sections 29, 31 and 33 longitudinally disposed in boat 11, placed one above the other and separated from each other by seam lines 35 and 37. Inflatable cell 15 is separated from inflatable cell 17 by seam lines 39, 41, 43 and 45. Seam lines 35 and 37 have respective breaks or openings 47, 49, 51 and 53 permitting the intercommunication of sections 29, 31 and 33 and the passage of pressurized gas therebetween for inflation thereof, while seam lines 35 and 37 still restrict the inflation of sections 29, 31 and 33. Openings 47 and 51, 49 and 53 are longitudinally displaced one from the other to prevent formation of a weak point at the openings which could cause peeling of a seam line 35 or 37 or consequent rupture of inflatable cell 15. Seam lines 35 and 37 of cell 15 are also each provided with a plurality of openings or breaks 55 which are vertically aligned with respect to each other to effect bending of all of sections 29, 31 and 33 thereat while inflated so that the end 57 of boat 11 wherein openings 55 are disposed assumes a curved shape as shown in FIG. 3. The length of each of the vertically aligned breaks 55 have been designed to minimum distance (which can for example be 1½–2 inches) whereby allowing flexure or bending in that area and still maintaining seam strength to resist seam peeling under pressure where the breaks 55 stop. The broken seam design 55 of all three sections 29, 31 and 33 of cell 15 at end 57 allows the portion of boat 11 at end 57 to form a curved pocket and flex to fit the user's shoulders. This enables the user to sit lower in boat 11, providing him with protection from wind, spray, etc. It also increases stability of boat 11 with the user disposed therein. The curved shape of end 57 permits the user to lean back in that end of boat 11 thereby lowering his center of gravity in the boat and lowering the combined center of gravity of boat and occupant. Longitudinal sections 63, 29, 31, 33 of boat 11 are straight and not curved or bent, so that sides 59 and 61 of the inflated boat are straight when viewed from the top, as shown in FIG. 3, and sections 63, 29, 31 and 33 are stacked vertically one above the other, as shown in FIG. 4. The curved shape of end 57 separates sides 59 and 61, resulting in greater comfort for the user, and since the sides are vertical, also resulting in a snugger fit with correspondingly improved stability for the boat and user combination. Otherwise, the user would sit higher and more forward without flexing in the area of end 57. As cell 17 is orally inflated by the user, boat 11 retains this shape. End 57 can be considered the stern of boat 11.

Inflatable cell 17 includes an upper section 63 located above cell 15 and communicating with the rest of cell 17 via channels 65 and 67. Channels 65 and 67 disposed in end 69 cause end 69, which can be considered the bow of boat 11, to be blunt and not pointed, providing comfortable room for the user's feet. It should be understood that the user can be disposed in boat 11 with his head toward end 57 and his feet toward opposite end 69. As a result, when cell 15 has been inflated and the user has entered boat 11, the user can immediately and easily increase the freeboard of boat 11 by inflating upper section 63 via oral inflation tube 23. Since upper section 63 is held above the water by the flotation provided by initially inflated section 15, there is not water pressure to interfere with inflation of upper section 63. Furthermore, since upper section 63 is held above the water before inflation by inflated section 15, oral inflation tube 23 is also held above the water for easy inflation of section 63. Thus, upper section 63 gives the user, once on board boat 11, the option to first bail or orally inflate, and oral inflation can be partial or complete. A few breaths of air put into upper section 63 by the user immediately after boarding gives extra freeboard around the perimeter of boat 11. The pressure at the water line, immediately after boarding, restricts the flow of air going to the lower area of section 17, so this initial inflation is kept in the upper section 63 and oral inflation thereof is accomplished with minimal effort. The importance of this feature is especially apparent in rough seas, where it is difficult to increase low freeboard by bailing, or in shark waters, where bailing to increase freeboard may draw sharks or other predators. After bailing, the remaining portion 71 of cell 17 of boat 11 can be orally inflated via oral inflation tube 23 which is connected thereto via channels 63 and 65. This remaining portion 71 of cell 17 is also provided, like cell 15, with seam lines 73 to reduce inflation which have breaks or openings therein to permit communication therebetween for transmission of air or other gas throughout cell 17. All seam lines in boat 11 have dot seals at their ends to reduce the likelihood of peeling of the seams from gas pressure.

The location of oral inflation tube 23 for cell 17 is located in upper section 63 conveniently close to the user's head, so that the user need only turn his head to be in position to accomplish oral inflation of boat 11. This position permits full thoracic expansion of the user, making oral inflation of boat 11 easier. The closeness and ease of reach of tube 23 allows the user to sit up straight during oral inflation, thereby permitting him to take full breaths and to exhale them comfortably. Since tube 23 is held above the water by initially inflated cell 15, bailing is no longer a necessity to increase freeboard initially, and the user has the option to bail or orally inflate and oral inflation can be partial or complete.

Boat 11 can be constructed of two sheets of material such as plastic or coated nylon placed one upon the other, cut to the desired shape as shown in FIG. 2, with all its seals and seam lines applied thereto such as by heat sealing, or glueing, the resulting structure being then folded over to form the boat shown in FIG. 1 whose edges, except for end 57 and the gunwale, are then sealed together to form boat 11. Sealing these edges together forms stem-like 75 (at end 69) and keel-like 77 seams for additional stability in high sea states. Except for the curved portion 79 near end 57 contoured for the buttocks of the user, the bottom seam 77 of boat 11 is straight keeping the user's hip-to-fit line straight, improving the user's posture and comfort and making it easier for the user to lean back in end 57. The straight line also permits the user to change his position in boat 11 fore-and-aft, such as may be desired for lowering the user's center of gravity in the raft and increasing stability. Seams 75, 77 and 79 constitute one continuous seam, so that the bottom of boat 11 is closed. A method of making boat 11 is disclosed in U.S. Pat. application Ser. No. 745,736.

In summary, operation of the foregoing invention is as follows. Before inflation and use, boat 11 can be compressed to a compact size, for example, 11 inches × 11 inches × 1 inch, and suitably encased. The user first actuates valve 25, for example by pulling a lanyard or chain attached thereto, so that pressurized gas passes from supply 19 through valve 25 and orifice 27 to inflate cell 15. Inflation of cell 15 gives boat 11 a firm shape so that the user can enter the boat. Because of openings 55 in seam lines 35 and 37, end 57 assumes, a curved shape when cell 15 is inflated. The user can then enter boat 11, by sliding backwards over end 69 or by rolling over side 59 or 61, or by grasping the sides amidship, pushing down and pulling the raft under himself, or by any other desired method. Water may enter boat 11 during initial deployment and boarding. The user positions himself with his head at end 57 and his feet towards end 69. The user can then increase freeboard of boat 11 by inflating section 63 via inflation tube 23. Tube 23 is conveniently located so that the user need only turn his head to inflate boat 11. Water pressure will prevent the air supplied to section 63 from entering the rest of section 17 until further inflation of cell 17 is accomplished. Bailing of boat 11 can then be accomplished with any convenient, conventional means, such as the user's helmet (if any). After bailing, the user fully orally inflates the rest of cell 17 via tube 23, thereby fully inflating boat 11. Cell 17 when fully inflated completes the shape of boat 11 and provides thermal protection from the water 13. Inflation tube 21 can be used to supplement or replace supply 19 for inflation of cell 15. When boat 11 is fully inflated, the body of the user forms the thwart structure of boat 11.

The user may effect transportation in boat 11, by using his arms, paddles, oars or other means for propelling boat 11 end 57 first through the water 13. The vertical alignment of inflated cells 29, 31 and 33 and the arcuately shaped end 57 serve to streamline boat 11 for easier translation through the water 13.

It should be understood that supply 19 can be attached to valve 25 in any position. Also, any material capable of being formed into airtight inflatable cells can be used in the construction of boat 11.

Thus there has been provided a novel inflatable mini boat capable of providing increased overall freeboard to the user immediately and easily. The boat has low initial freeboard for ease of entry, which freeboard can be readily and quickly increased by the occupant after boarding for his protection, and without water or water pressure resisting or preventing such increase in freeboard. The boat provides thermal protection and protection from wind and spray for the user. Oral inflation of the boat can be accomplished readily and without first bailing the craft. Furthermore, the boat is configured to permit greater comfort and stability and allows the user to lower his center of gravity in the boat.

Obviously, many modifications and variations of the present invention are possible in light of the above teachings. It is therefore to be understood that within the scope of the appended claims the invention may be practiced otherwise than as specifically described.

What is claimed is:

1. An inflatable boat having a hull of inner and outer panels contoured to closely conform to an occupant seated in the stern with his legs extended forwardly, and partitioned by continuous seams between the opposed surfaces of said panels into first and second separately inflatable cells co-directional with the length of said boat; wherein the improvement comprises:

first and second intercommunicating sections formed in said second cell respectively above and below the first cell, said first section forming thereby the gunwale of said boat; and first and second inflatable channels disposed in the bow of said boat intercommunicating between said first and second sections and causing the bow to assume a blunt shape.

2. An inflatable boat having a hull of inner and outer panels contoured to closely conform to an occupant seated in the stern with his legs extended forwardly, and partitioned by continuous seams between the opposed surfaces of said panels into first and second separately inflatable cells co-directional with the length of said boat; wherein the improvement comprises:

first and second intercommunicating sections formed in said second cell respectively above and below the first cell, said first section forming thereby the gunwale of said boat;

said first cell partitioned along its length into a plurality of interconnected tubular segments communicating through a plurality of vertically aligned prearranged passages disposed at and about the stern of said boat for inflation of said first cell and bending thereof for curving the stern of said boat with inflation of said first cell.

* * * * *